United States Patent [19]

Gilchrist, Jr.

[11] Patent Number: 4,588,329

[45] Date of Patent: May 13, 1986

[54] PROPULSION METHOD AND APPARATUS FOR ADVANCING A MARINE PIPELINE EXCAVATION SHIELD

[75] Inventor: Robert T. Gilchrist, Jr., Houston, Tex.

[73] Assignee: Shell Oil Company, Houston, Tex.

[21] Appl. No.: 641,629

[22] Filed: Aug. 17, 1984

[51] Int. Cl.[4] ..... E02D 17/00; E21D 10/00; F16L 1/04

[52] U.S. Cl. ..... 405/283; 405/141; 405/159

[58] Field of Search ..... 405/141, 142, 145, 154, 405/158–165, 174, 180, 184, 272, 282, 283

[56] References Cited

U.S. PATENT DOCUMENTS

| | | | |
|---|---|---|---|
| 2,715,889 | 8/1955 | Bixler et al. | 405/283 |
| 2,908,140 | 10/1959 | Everson | 405/283 |
| 3,608,319 | 9/1971 | Quitadamo | 405/283 |
| 3,916,629 | 11/1975 | Thompson | 405/283 |
| 3,967,454 | 7/1976 | Barnes | 405/282 |
| 4,044,565 | 8/1977 | Stuckmann | 405/283 |

FOREIGN PATENT DOCUMENTS

| | | | |
|---|---|---|---|
| 2838949 | 3/1980 | Fed. Rep. of Germany | 405/283 |
| 1295382 | 11/1972 | United Kingdom | 405/283 |

*Primary Examiner*—Cornelius J. Husar
*Assistant Examiner*—Nancy J. Stodola

[57] ABSTRACT

One construction method for burying offshore pipelines utilizes a segmented excavation shield for forming a trench in the seafloor. The present invention provides a propulsion method for advancing the shield which eliminates the need to pull the shield. This is done by advancing skin plates which are attached to the shield, then advancing the shield by transmitting soil reaction through the skin plates, which remain stationary, to the shield.

7 Claims, 5 Drawing Figures

PROPULSION METHOD AND APPARATUS FOR ADVANCING A MARINE PIPELINE EXCAVATION SHIELD

BACKGROUND OF THE INVENTION

When large diameter, relatively stiff pipes are lowered into an undersea trench, the usual elastic curvature is such that an unacceptably long span develops, and the corresponding open section of the trench may be too long to be practical unless stable slopes have been cut. For example, if a 12-foot deep trench were in a sandy soil, the slope of the trench sidewalls might be on the order of one in three, and the amount of soil to be excavated could be five times that of a vertical sidewall ditch. Accordingly, it is not only desirable to reduce the volume of soil to be excavated, but further to prevent infilling of the soil until the pipe has reached the ditch, both to reduce power requirements and save time in construction. One solution to this problem is disclosed in application Ser. No. 562,363 filed Dec. 16, 1983, wherein an underwater trencher with pipelaying guide is provided for the simultaneous trenching and installation of submarine pipelines by a technique which greatly reduces the volume of soil to be excavated by preventing infilling until the pipe has reached the bottom of the trench, which trencher is relatively convenient and economical to use and saving of construction time, and which greatly reduces power requirements. First, a trench is formed while simultaneously an elongated shield is positioned in the trench to prevent the sidewalls of the trench from collapsing. Then, a pipeline is deflected into the trench so that the pipeline enters the trench at one end of the shield and approaches the bottom of the trench before exiting at the other end of the shield. Preferably, the pipeline is subjected to bending strain, for example, in a range of about 0.002 to 0.003 or greater, which greatly reduces the length of shield required, which nonetheless is a large piece of equipment, typically over 100 feet in length. If the shield is pulled (e.g. with cables) to overcome soil resistance (friction and cutting head pressure), the draw force required is in the range of hundreds of kips (1 kip=1,000 lbs). Accordingly, it is desirable to provide means for reducing or obviating these extreme requirements of pulling force necessary for advancing the shield.

SUMMARY OF THE INVENTION

The primary purpose of the present invention is to provide a method and apparatus for the propulsion of a marine pipeline excavation shield, which greatly reduces the power requirements normally necessary to move the apparatus and which thereby saves construction time. Thus, the present invention provides a method for advancing an elongated segmented excavation shield, said shield having attached skin plates, in a soil trench comprising sequentially advancing the skin plates by moving fewer skin plates forward at any one time than the non-moving skin plates and shield segments can transmit soil reaction to the moving skin plates; and simultaneously moving the shield segments forward by transmitting soil reaction through at least part of the skin plates which are maintained motionless. Preferably, a surface is utilized on the skin plate segments which is resistant to rearward movement.

The present invention also pertains to an elongated excavation shield comprising a series of individually movable, connected shield segments, at least part of the shield segments having attached independently movable skin plates; and means for sequentially advancing the skin plates by moving fewer skin plates forward at any one time than the non-moving skin plates and shield segments can transmit soil reaction to the moving skin plates; and simultaneously moving the shield segments forward by transmitting soil reaction through at least part of the skin plates which are maintained motionless.

Other purposes, distinctions over the art, advantages and features of the invention will be apparent to one skilled in the art upon review of the following.

DESCRIPTION OF PREFERRED EMBODIMENTS

The present invention pertains to an apparatus and method for the simultaneous trenching and installation of submarine pipelines and more particularly, to a propulsion method for moving the apparatus. The apparatus includes, in a single unit, an excavating portion, an attached ditch sidewall retention shield, and a pipeline installation guide. Individual segments comprising the shield are connected by moving means, more particularly described hereinafter, which furnishes propulsion to the shield. The excavator creates a trench of slightly larger cross section than required, the shield prevents the trench from closing due to collapse of the sidewalls, and the pipe guide causes the pipeline to be deflected into that portion of the trench protected by the shield. The pipeline preferably is fabricated on the surface of the sea or on floating ice and is supported and guided to enter the forward portion of the shield by a stinger or other means, when required. The disclosure of patent application Ser. No. 562,363 filed Dec. 16, 1983 particularly describes the shield, pipeline insulation guide and excavator, and is incorporated hereinto.

The excavation shield must readily move forward through the soil during the construction process. For practical pipe sizes and burial depths, geometrical constraints result in a very large piece of equipment, typically over 100 feet in length. If such a system is pulled to overcome soil resistance, the draw force required is in the range of hundreds of kips. The propulsion method for the shield, as disclosed herein, eliminates the need to pull the device. The method may be described as an "inch-worm" method of advancement and may be implemented as follows. The exterior of the excavation shield is covered with a network of power actuated reciprocating skin plates. To achieve "inch-worm motion" the skin plates are stroked to a forward position either one at a time or in groups, the criteria being no global movement of the shield. The plates are then stroked back together, resulting in forward motion of the entire device. The disclosure of patent application Ser. No. 641,628 filed Aug. 17, 1984 describes a related shield propulsion method, and is incorporated hereinto.

Advantages of the "inch-worm" method are, (1) there is no limiting size; the method can be scaled up as required to accommodate pipe and trench geometry; (2) there is a minimum of moving parts; and (3) a reverse control sequence permits the unit to back up. Other improvements that add to the efficient utilization of the device include a special surface (e.g. a "fish scale" surface) on the skin plates to improve an advance/engage friction ratio so that larger fractions of plates can be moving at a given time.

Having thus generally described the apparatus and method of the invention, as well as its advantages over the art, the following is a detailed description thereof given in accordance with specific reference to the drawings.

Figure 3:
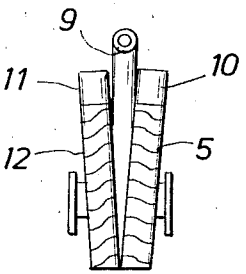
FIGS. 2 and 3 show plan and end views of the trench shield in the excavating module of FIG. 1.
Figure 2:
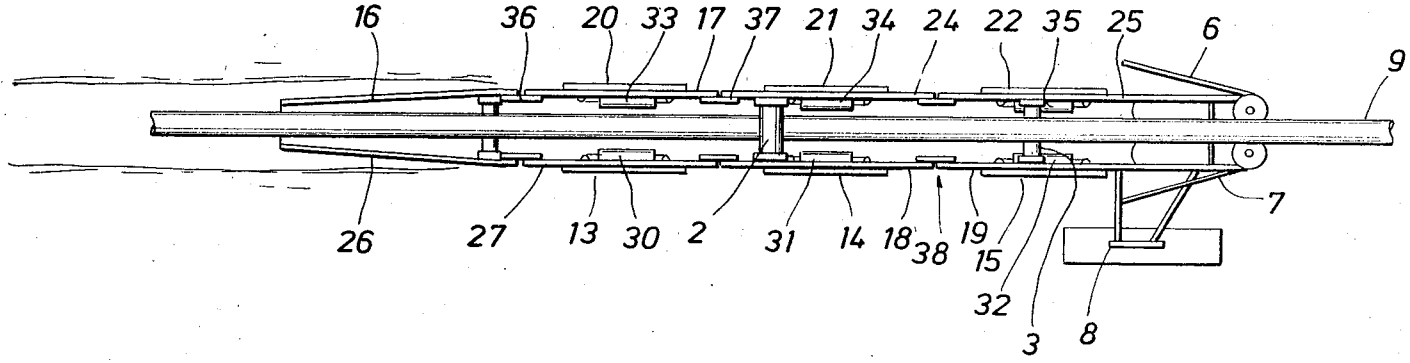
Figure 1:
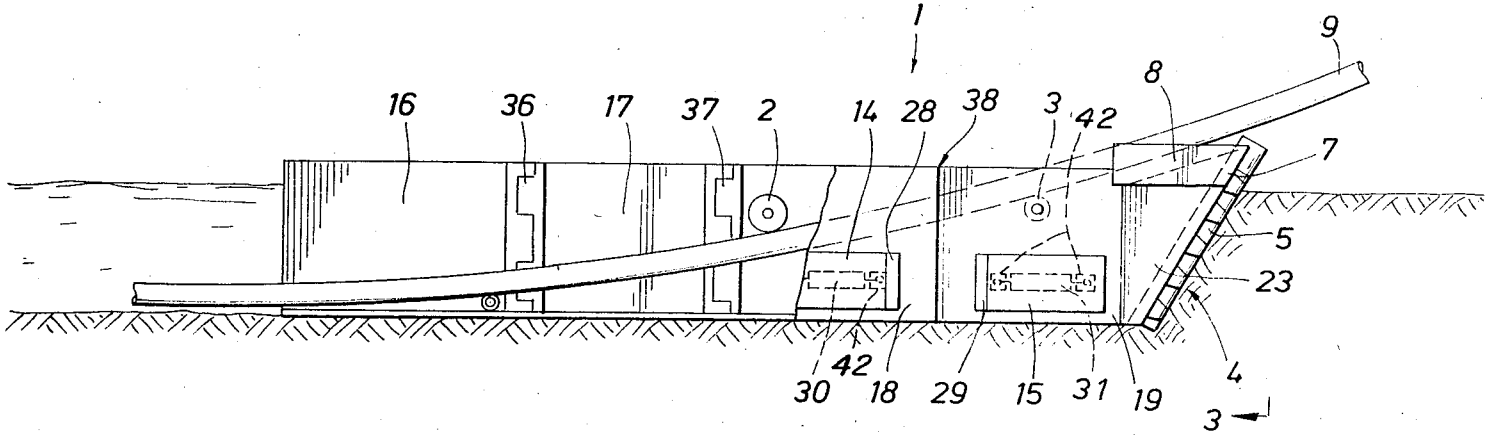
FIG. 1 shows an elevation view and partial section of a trench shield and excavating module of the invention.

FIGS. 1, 2 and 3 show respectively, elevation, plan and front views of the invention. A trench shield 1 having pipeline guide rollers 2 and 3, has at the forward end thereof, excavating module 4. Excavating module 4 has cutters 5 and 12 which may be lengthened if required. Cutters 5 and 12 may be tilted or advanced or retracted into the work space by hydraulic pistons internal to the unit (not shown). The cutters 5 and 12 may also be raised or lowered relative to the module 4 as a means of adjusting the elevation of the trench bottom. Mold boards 6 and 7 at either side of the excavating module serve to push spoil away from the trench shield 1. Sled 8 maintains the trench shield 1 at an appropriate level in the soil. Pipeline 9 passes over module 4, between rollers 2 and 3 and exits at the lower rear of shield 1.

FIG. 3 is a front view of the excavating module 4 and shows motors 10 and 11 which may be hydraulic or electric powered and which powers the cutters 5 and 12 (e.g. augers) which are tiltable to form a trapezoidal cross section, for example, about 16 degrees apart, to clear the suspended pipeline 9 in the event cutters 5 and 12 are to be replaced while the module 4 remains in the trench.

Sliding skin plates 13, 14, 15, 20, 21 and 22 and associated hydraulic ram skin actuators 30–35, provide motivation or propulsion for the trench shield. These rams may be actuated by hydraulic fluid (not shown) or by electric means, e.g. a motor (not shown). In either event, the rams operate to alternately or sequentially push the skin plates forward and then pull the skin plates back. Thus, as shown in FIG. 1, skin plate 15 has been stroked forward to a length revealing base plate 29, while skin plate 14 has not yet been stroked forward since base plate 28 shows up on the right side of skin plate 14. When skin plates 13, 14, 15, 20, 21 and 22 are stroked back together, they move associated shield segments 17, 18, 19, 24, 25, and 27 forward along with trailing shield segments 16 and 26 (all of which are hinged together as with hinges 36 and 37) and the rest of the trench shield 1.

Figure 4:
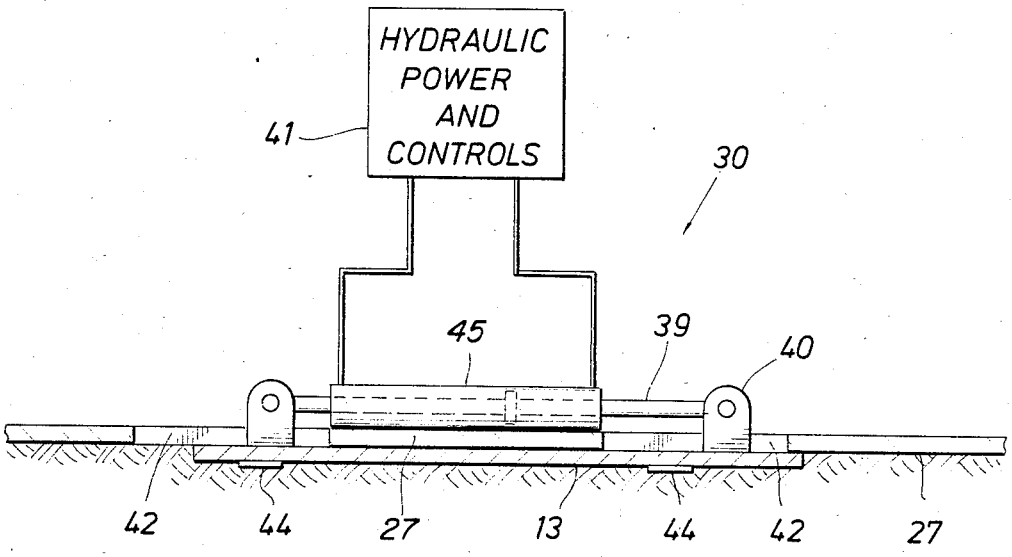
FIG. 4 is a section taken parallel to the stroke of the plates of FIGS. 1–2 and FIG. 5 is a section taken perpendicular to the stroke of the plates of FIGS. 1–2.
Figure 5:
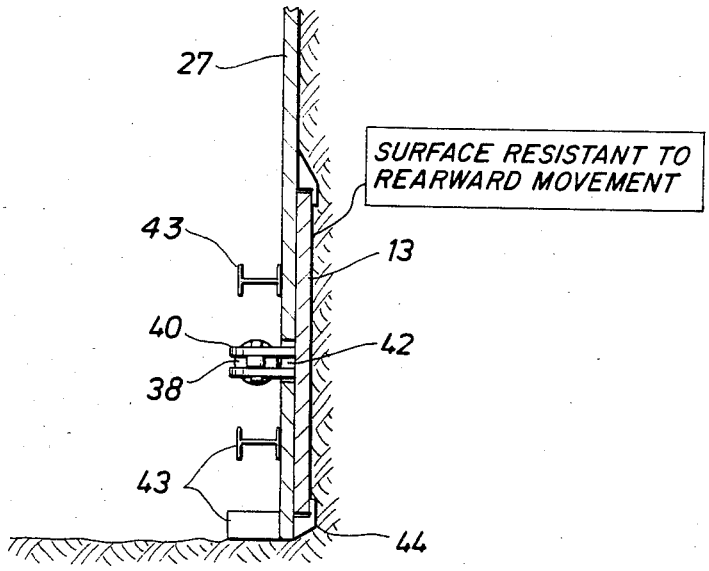

FIGS. 4 and 5 are sections parallel and perpendicular to the stroke of the skin plates, respectively. The hydraulic ram skin actuator 30 comprises a hydraulic cylinder 45, hydraulic ram 39 and connector assembly 40, and hydraulic power and controls 41. The actuator 30 preferably is on the opposite side of shield segment 27 from skin plate 13 and the connector assembly 40 extends through opening 42 in shield segment 27 which is braced by chassis elements 43. Guide channel 44 supports skin plate 13 adjacent to shield segment 27.

The arrangement of the skin plates would depend on the configuration of the excavation shield. Specifically, the shield may be configured with or without a bottom. No bottom would allow it to be engaged and disengaged from the pipeline with a minimum of difficulty. If the shield has a bottom, sliding skin plates would be placed on the bottom and sides of the apparatus. If the shield is of the open bottom type, skin plates would only be employed on the sides.

The foregoing description of the invention is merely intended to be explanatory hereof and various changes in the details of the described method and apparatus may be made within the scope of the claims without departing from the spirit of the invention.

What is claimed is:

1. A method for advancing an elongated, segmented excavation shield in a soil trench comprising:

attaching independently movable skin plates to at least part of the shield, the skin plates being located between the shield and a wall of the trench and having lesser surface area than the shield;

advancing at least part of the skin plates by transmitting soil reaction from non-moving skin plates and shield segments to the moving skin plates; and then moving at least part of the shield segments forward by transmitting soil reaction from non-moving skin plates.

2. The method of claim 1 including utilizing a surface on the shield segments which is resistant to rearward movement.

3. The method of claim 1 wherein the shield is backed up by reversing the movement of the skin plates.

4. An elongated excavation shield for use in a soil trench comprising;

a series of connected shield segments, at least part of the shield segments having attached independently movable skin plates which are located between the shield and a wall of the trench and which have lesser surface area than the shield;

means for advancing at least part of the skin plates by transmitting soil reaction from the non-moving skin plates and shield segments to the moving skin plates; and means for then moving at least part of the shield segments forward by transmitting soil reaction from non-moving skin plates.

5. The excavation shield of claim 4 including utilizing a surface on the shield segments which is resistant to rearward movement.

6. The excavation shield of claim 4 including at least one hydraulic ram comprising a hydraulic cylinder attached to a shield segment and having a hydraulic ram and connector assembly which extends through an opening in the shield segment and attaches to a skin plate.

7. The excavation shield of claim 6 wherein the hydraulic cylinder has two hydraulic rams, each extending out of an opposite end of the hydraulic cylinder and connected to a connector assembly which extends through one of two openings, respectively, and attaches to a skin plate.

* * * * *